US006761427B1

(12) United States Patent
Owen et al.

(10) Patent No.: US 6,761,427 B1
(45) Date of Patent: Jul. 13, 2004

(54) ESTIMATING CONSUMABLE SUFFICIENCY BEFORE PRINTING

(75) Inventors: Kevin Owen, Meridian, ID (US); Jeetendra Kumar, Boise, ID (US); Travis Moats, Nampa, ID (US); Roman Wachter, Boise, ID (US); Mark Clark, Meridian, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/341,822

(22) Filed: Jan. 14, 2003

(51) Int. Cl.[7] ..... B41J 29/393
(52) U.S. Cl. ..... 347/19; 399/24
(58) Field of Search ..... 347/7, 19; 399/23, 399/24, 27

(56) References Cited

U.S. PATENT DOCUMENTS 4,627,715 A * 12/1986 Kikuno ..... 399/27
4,835,573 A * 5/1989 Rohrer et al. ..... 399/23
6,275,664 B1 * 8/2001 Wolf et al. ..... 399/23
6,366,744 B1 4/2002 Phillips et al. ..... 399/24
6,453,129 B1 * 9/2002 Simpson et al. ..... 399/23
6,471,314 B2 * 10/2002 Doi ..... 347/19

FOREIGN PATENT DOCUMENTS

JP 57202570 A * 12/1982 ..... G03G/15/08

* cited by examiner

*Primary Examiner*—Thinh Nguyen
*Assistant Examiner*—Julian D. Huffman

(57) ABSTRACT

A requirement of a replaceable component to print a print job at a printing device is derived from a predetermined use per page of the replaceable component at the printing device. If an availability of the replaceable component at the printing device is less than the requirement, a diagnostic is output. The requirement and the availability are approximations expressed in a number of pages.

33 Claims, 7 Drawing Sheets

40

| Replaceable Component | Sensor(s)/ Counter(s) | End-of-Life Calculation |
|---|---|---|
| Paper | Paper Tray/Optical/ Mechanical/Weight Sensor/Page Counter | Compare Reading(s) To No. Of Pages Determined By Driver To Be In The Print Job |
| Toner/Ink Cartridge(s) | Optical/Mechanical/ Volume Sensor(s)/ Page Counter(s) | Based Upon Historical (or default) Data of Toner/Ink Usage Per Page, Estimate Usage For No. of Pages As Determined By Driver and Compare to No. of Pages Already Printed With Toner/Ink Cartridge(s) or to Toner/Ink Measurement |
| Output Bin Level Sensor | Optical/Mechanical/ Weight Sensor(s) Page Counter(s) | Compare Reading(s) To No. Of Pages Determined By Driver To Be In The Print Job |
| Staples | Optical/Mechanical/ Weight Sensor(s)/ Counter(s) | Compare Reading(s) To No. Of Staples Needed As Determined By Driver For The Print Job |
| Drum | Page Counter(s) History Counter | Based Upon Historical (or default) Data of Drum Usage Per Page, Estimate Usage For No. of Pages As Determined By Driver and Compare to No. of Pages Already Printed With Drum or to Direct Drum Measurement(s) |
| Developer | Page Counter(s) History Counter | Based Upon Historical (or default) Data of Developer Usage Per Page, Estimate Usage For No. of Pages As Determined By Driver and Compare to No. of Pages Already Printed With Developer or to Direct Developer Measurement(s) |
| Fuser | Page Counter(s) History Counter | Based Upon Historical (or default) Data of Fuser Usage Per Page, Estimate Usage For No. of Pages As Determined By Driver and Compare to No. of Pages Already Printed With Fuser or to Direct Fuser Measurement(s) |
| Transfer Belt | Page Counter(s) History Counter | Based Upon Historical (or default) Data of Transfer Belt Usage Per Page, Estimate Usage For No. of Pages As Determined By Driver and Compare to No. of Pages Already Printed With Transfer Belt or to Direct Transfer Belt Measurement(s) |

Fig. 8

ESTIMATING CONSUMABLE SUFFICIENCY BEFORE PRINTING

FIELD OF THE INVENTION

The present invention relates to printing that uses a consumable. More particularly, the invention relates to printing a print job after the availability of the consumable has been estimated to be sufficient to print the print job.

BACKGROUND OF THE INVENTION

Most types of printing devices are equipped with items that are used up and/or have a life cycle during printing operations. These items can include one or more printing supplies, a printing media (e.g. paper) available to be printed on during the printing, a printing substance (e.g. ink, toner, etc.) available for application to the printing media during the printing, a laser printer drum, a laser printer developer, a laser printer fuser, a printing media transfer belt, staples for stapling the printing media during the printing process, a storage volume that is available to store paper that has been printed on by the printing device, and the like. These items are referred to herein as replaceable components. When a replaceable component is exhausted or is at the end of its life cycle, the replaceable component must be replaced and/or replenished in order for the printing device to continue to function properly. For example, a replaceable component can be refilled when it is exhausted, or a container that contains an exhausted replaceable component can be removed and a full replaceable component installed in a printer to provide a refilled printing supply for the printing process.

Replaceable components can be manufactured with memory which can be placed on the replaceable component itself or within a label affixed to the replaceable component. This memory is typically used to store printer-related data that the printer reads to determine various printing parameters. For example, the memory may store the model number of a toner cartridge so that the printer may recognize the toner cartridge as valid or invalid for use with that printer. The memory could be both on the replaceable component and/or maintained on the printer.

As documents are printed, the replaceable component is gradually depleted. The printer can communicate with the replaceable component to determine when a state of exhaustion (e.g. an end-of-life condition) has been reached. Once the replaceable component is deemed to have been exhausted, the printer may stop printing. The printer is also typically configured to resume printing when the replaceable component is replaced. The cessation from printing can occur at any point in a print job that a user has requested and has been waiting for. The user cannot determine, prior to scheduling the requested print job, whether or not the replaceable components needed for the requested print job are sufficient to complete the requested print job. Frustration can arise for the user where the job is scheduled yet can only be partially printed by the printer due to an unforeseen lack of one or more replaceable components. Consequently, there is a need for improved methods, computer-readable media, and host computing systems that provide a user with advance notice as to the availability of a replaceable component for a print job.

SUMMARY OF THE INVENTION

The above-stated needs and/or others are met, for example, by calculating a requirement of a replaceable component to print a print job at a printing device. A diagnostic is output if an availability of the replaceable component at the printing device is less than the requirement. The requirement and the availability are approximations expressed in a number of pages and the requirement is derived from a predetermined use per page of the replaceable component at the printing device.

DESCRIPTION OF THE DRAWINGS

Implementations are illustrated by way of example and not limitation in the figures of the accompanying drawings. The same numbers are used throughout the figures to reference like components and/or features.

FIG. 8 is an implementation of a table of entries, each listing a replaceable component, a measurement tool, and a corresponding End-of-Life Calculation.

DETAILED DESCRIPTION

Figure 1:
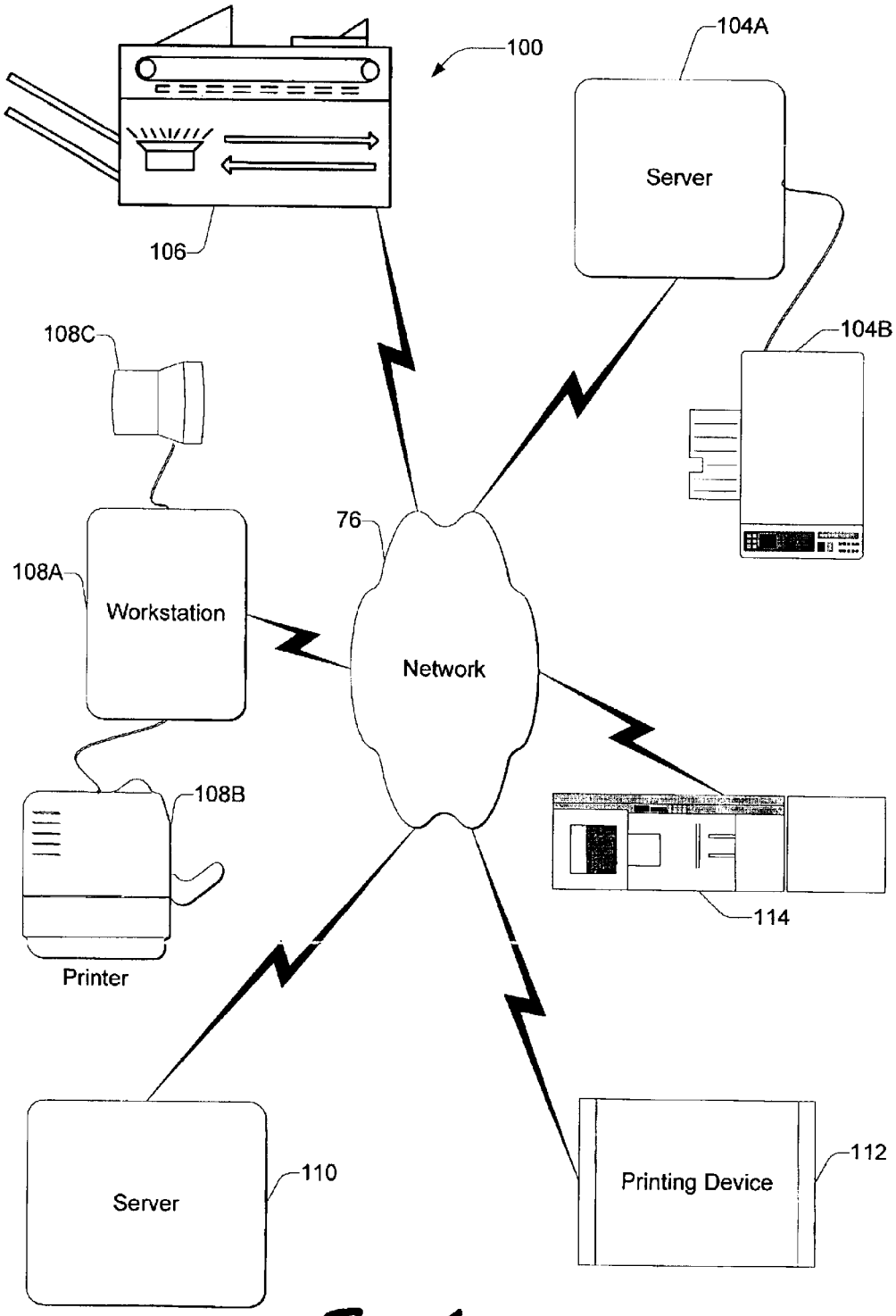
FIG. 1 illustrates an implementation of a network environment in which multiple servers, one or more workstations, and printers are coupled to one another via an interconnected network.

Methods, computer-readable media, and host computing systems, according to various implementations, relate to a client device or document processing device such as personal computer (PC) that executes an interactive computer program. The program approximates if the print job can be printed given the amount of replaceable components needed for the printing. This approximation is made without a processor-intensive pre-rasterization of the job. Rather, the approximation uses a gross 'per-page' derivation that is computationally non-rigorous. The program allows a user to input a specific number of pages to print in a job. The interactivity of the software enables the user to get a hard copy of the specific number of pages input by the user that the user subjectively considered as most important when any of several enumerated supplies are low. The software uses a relatively low number of processor cycles.

By way of example, the program can be document processing application, such as a word processor application, that creates and/or stores a document that is to be output at a printing device. The program can have one or more printer driver applications that create print data from the document that has been stored and/or created, such as by a document processing application. In order to print out the document, the document processing application receives a request for a printing function to obtain a printout on a printing device specified in the requested printing function.

Once the printing function has been requested, one or more printer driver applications then calculate the number of pages that are to be printed in a print job in which the created print data will be printed. Historical data is maintained as to how much of each replaceable component was used for prior print jobs. From the historical data, an estimate is made as to the usage per page of printing for each replaceable component. In addition to the historical data, a default usage per page can also be maintained. The usage per page of each replaceable component can then be extrapolated to further estimate a requirement for each of the one or more replaceable components in order to print out all of the pages of the print job that have been requested by a user.

The availability of each replaceable component at the printing device can be determined from examining historical data as to any prior use of each of the one or more replaceable components in view of their respective service life. For instance, if a last printer drum is estimated to be able to function properly during the printing of fifteen thousand (15,000) pages during its serviceable life, and a counter indicates that fourteen thousand (14,000) pages have already been printed, then it may be estimated that the drum has an availability of one thousand (1,000) pages. Alternatively, the availability can be determined by directly measuring one or more of the replaceable components at the printing device. For instance, a stack of paper that is to be printed on that is measured as weighing four (4) pounds may indicate an availability of one thousand (1000) pages.

When measuring the replaceable components, conventional measurement tools can be used, such as one or more sensors that communicate with the printing device and/or its components to determine the amount, weight, level, quality condition, and/or quantity of the various replaceable components. Whether the availability of replaceable components at the printing device is estimated from historical data or is directly measured, in either case, the respective availability for each replaceable component is converted into a respective number of pages that can be printed using respective replaceable components. The availability number of pages for each replaceable component can then be respectively compared to the requirement number of pages for each replaceable component for all of the pages of the print job. As such, any deficiency in a replaceable component to complete all of the pages of the print job can be expressed as the requirement number of pages less the availability number of pages. Accordingly, a negative number reflects a sufficient availability of a replaceable component at the printing device to print all of the pages of a print job.

The sufficiency of each replaceable component to print all pages of a print job is judged by a query between a requirement for the print job and an availability at the print device. If the query determines that there is sufficient availability of each replaceable component to print the entire print job, then the printing function sends print data to the requested printing device and the printing of a corresponding print job begins and continues to the completion of the entire print job. If the query determines that the availability of one or more of the replaceable components needed to print a print job is lacking, a diagnostic identifying the deficient one or more replaceable components will be output along with the number of pages that the printing device will be able to print out given the measured and/or estimated availability of the deficient one or more replaceable components. The user is prompted to continue anyway or to input the number of pages that the user wishes to have printed. Given the identified availability deficiency of the one or more replaceable components, the user may input a number of pages that is less than or equal to the identified number of pages that the printing device can be print before exhausting the identified one or more replaceable components that have been found to be insufficient for printing the entire print job. The printing function then sends print data to the requested printing device and the printing of a corresponding print job begins and continues for the number of pages specified by the user's input in response to the prompt.

The printing device can include a memory for storing replaceable component usage data used in estimating the availability of the corresponding replaceable component and then evaluating how much of the replaceable component can be used before arriving at an end-of-life condition for the replaceable component. The replaceable component usage data in the memory is updated during the printing. The memory can, but need not be, integral with the replaceable component. Examples of integral memory are a radio frequency identification (RFID) memory and a direct contact identification memory.

The end-of-life condition of a replaceable component can be an insufficiency of printing supplies in the replaceable component. By way of example, and not by way of limitation, this insufficiency can be the printing media (e.g. paper) available to be printed on during the printing, the printing substance (e.g. toner, ink, etc.) available for application to the printing media during the printing, staples that are available for stapling the printing media during the printing, storage available for storing the printing media after it has been printed by the printing device, etc.

In various implementations, the printing device and/or the replaceable component can have one or more sensors. Each sensor can sense an aspect of the replaceable component to measure its availability at the printing device. When a printing device is printing, the printing device will be stopped in response to an end-of-life condition of the replaceable component that is signaled by a corresponding measurement of the one or more sensors. Moreover, the measurements made by the one of more sensors for any replaceable components are used in comparisons with the requirements of a print job so as to compute and identify, in advance of printing the print job, any insufficiencies in one or more of the replaceable components that are needed to print the print job. Additionally, counters can be used to accumulate historical data as to the past use of a replaceable component. This historical data can be used alone or in combination with the one or more sensors to determine availability of replaceable components for printing a print job prior the printing thereof.

The printing device communicates with a host computing system that has an input mechanism to receive a demand for a printing operation. The input mechanism can be a keyboard, a computer mouse, a button, a toggle switch, or other known input systems that can be activated by a user. The host computing system has an output mechanism associated with the printing device upon which a diagnostic can be displayed that identifies one or more replaceable components lacking in availability to print a requested print job. The output mechanism can be a display screen in communication with the host computing system that is in communication with the printing device. The diagnostic can also be printed on a hardcopy printout by the printing device or another printing device.

Memory in the printing device, in the replaceable component, and/or in the host computing system can be used to store measurements made with respect to the availability of replaceable components and to store replaceable component usage data. These data can be stored in a memory device periodically during the printing operations and/or at predetermined intervals during the printing operations, where the data is initialized after the replaceable component is installed in the printing device. The stored data can be used to calculate when one or more replaceable components are at an end-of-life condition. Real time measurements of replaceable components can be compared to calculated print job requirements to determine when one or more required replaceable components will be at an end-of-life condition prior to the completion of a requested print job. This determination can be output and reviewed by a user prior to starting the printing of the print job at the printing device.

By way of example, and not by way of limitation, a laser printer can have one or more toner cartridges that are installable in and removable from the laser printer. The toner cartridges can have one or more sensors that are configured to sense a quantity of toner (e.g. a weight measurement in grams) that remains. Alternatively, a page counter can be kept for each toner cartridge to determine how many pages have been printed using each toner cartridge, where the page count is accumulated in replaceable component use data for each toner cartridge. Readings from the one or more sensors can be acquired by a reader/writer located in the laser printer that monitors the one or more sensors as well as any replaceable component usage data for the one or more toner cartridges. Using a predetermined number of pages that can be printed using each of one or more toner cartridges, an estimate can then made as to how many pages can still be printed using the remaining toner in each toner cartridge. As another alternative, a sensor can measure the remaining amount of toner in each toner cartridge. An estimate can then be made, using historical data as to how much toner is used per page, as to how many pages can still be printed using the remaining toner in each toner cartridge. The foregoing measurements and estimations can be used to arrive at a determination as to the availability of toner in the one or more toner cartridges to print the requested document. A deficiency of availability can be output in a diagnostic for review by the requesting user.

FIG. 1 illustrates a network environment 100 in which a plurality of network resources are coupled via an interconnected network 76. As such, multiple servers 104A, 110, a workstation 108A, and printing devices 104B, 106, 108B, 112, 114 are coupled to one another via interconnected network 76. Interconnected network 76 couples together servers 104A and 110, computer workstation 108A, printing devices 104B, 106, 108B, 112, and 114, and a computer monitor 108C. Printing devices 104B, 108B and computer monitor 108C are coupled to interconnected network 76 through their respective local connections to server 104A and workstation 108A. Interconnected network 76 can be any type of network, such as a local area network (LAN) or a wide area network (WAN), using any type of network topology and any network communication protocol. In a particular embodiment, interconnected network 76 can be the Internet. Although only a few devices are shown coupled to interconnected network 76, a typical network may include tens or hundreds of devices coupled to one another. Furthermore, interconnected network 76 may be coupled to one or more other networks, thereby providing coupling between numerous devices. A user can schedule a print job at any server 104A, 110 or workstation 108A to be printed at any printing device 104B, 106, 108B, 112, 114.

Servers 104A and 110 may be file servers, e-mail servers, database servers, print servers, or any other type of network server. Workstation 108A can be any type of computing device, such as a mobile computing device, including a personal computer, a laptop computer, and a personal digital assistant (PDA). Although not shown in FIG. 1, one or more workstations and/or servers may contain a print rendering engine capable of converting raw print job data into a particular format (e.g., language) understood by certain types of printers.

Particular implementations illustrate an ink jet printer 104B and laser printers 106, 108B. Alternate implementations, however, use other printers such as printing device 112 that is illustrated as being in communication with interconnected network 76 independent of a server or workstation. Printing device 112 is intended to represent a printer to which output can be directed from a computing device, including but not limited to, laser printers, ink-jet printers, bubble-jet printers, copiers, fax machines, and the like. Additionally, printing device 112 can be any type of device that can output a print job by hardcopy such as on paper, and any other type of printer including those referred to above. A digital press or network copier 114 is seen in FIG. 1 as a printing device to which output can be direct according to at least one implementation.

Figure 2:
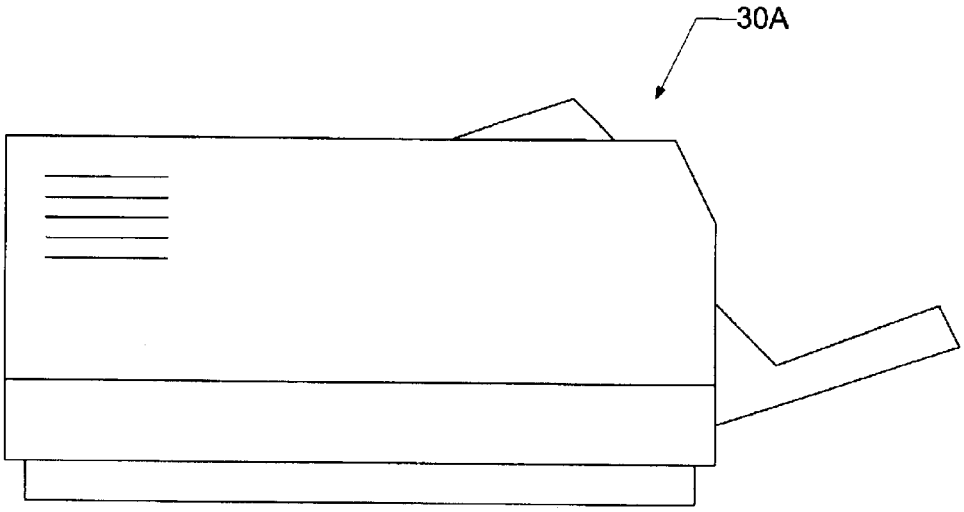
FIG. 2 is a diagrammatic illustration of an implementation of a laser printer.
Figure 3:
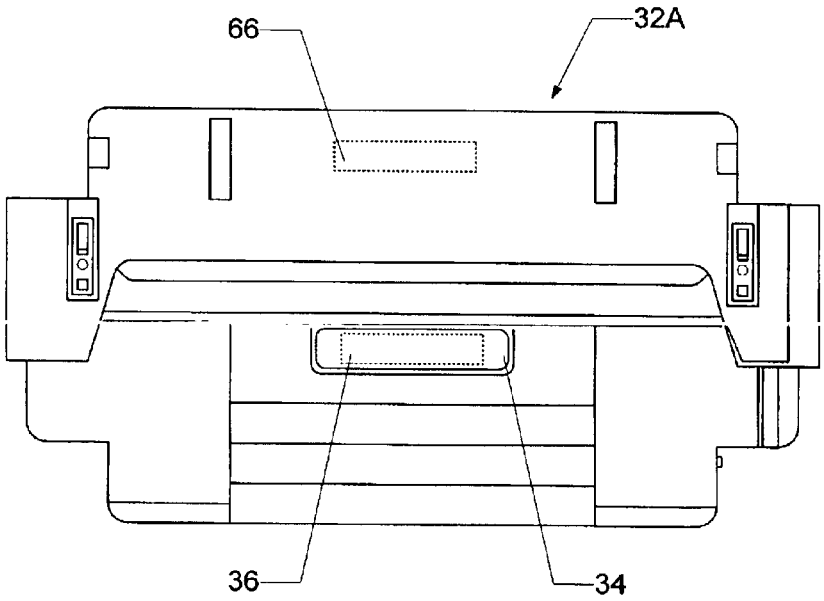
FIG. 3 is a diagrammatic illustration of an implementation of a laser printer toner cartridge in a laser printer.

FIG. 2 is a diagrammatic illustration of a laser printer 30A in an implementation. FIG. 3 shows a toner cartridge 32A that is installable in the laser printer 30A. The toner cartridge 32A has a label 34 that contains information identifying the toner cartridge 32A to a user. The label 34 typically recites the name of the manufacturer, the model number of the cartridge, etc. Although various implementations are shown and described herein with respect to a printer toner cartridge for a laser printer, it is noted that other implementations may be embodied as any replaceable component (toner cartridge, ink cartridge, fuser, drum, etc.) installable in a printing device (printer, copier, fax machine, etc.).

A memory tag 36 is located underneath the label 34 on the toner cartridge 32A, although the memory tag 36 may be placed on or in the toner cartridge 32A at any location which may be practical for the purposes described herein. The memory tag 36, which can be conventional semiconductor memory, can communicate with laser printer 30A by a direct electrical connection thereto, and would be, as such, a direct connection memory tag. Alternatively, memory tag 36 can be an RFID memory tag. RFID memory tags, sensor communications, and applications therefore are well known in the art. One or more sensors 66 can be in and/or on the toner cartridge 32A so that they can be used to sense and/or measure a quantity of toner that is available in the toner cartridge 32A.

Figure 4:
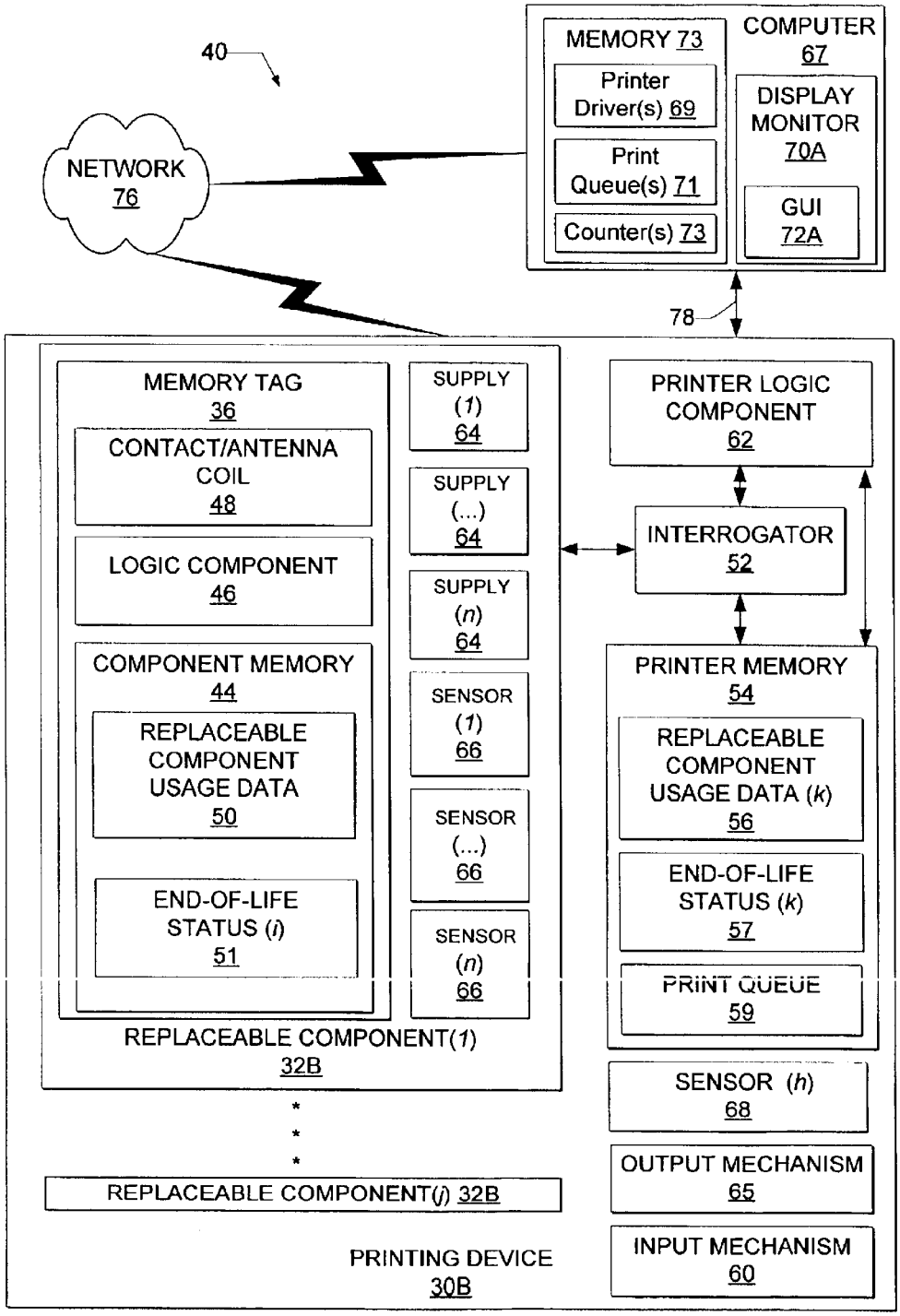
FIG. 4 is a block diagram of an implementation of a printing system.

FIG. 4 is a block diagram of a printing system 40 that includes a printing device 30B. Printing device 30B has replaceable component (l) 32B through replaceable component (l) 32B. Each replaceable component 32B is installed in printing device 30B and may be removed and replaced by a like replaceable component (not shown). Each replaceable component 32B can include a memory tag 36 and one or more of supply (l) 64 through supply (N) 64. When printing device 30B prints, one or more of supply (l) 64 through supply (N) 64 are used in order to accomplish the printing. Use of supply (l) 64 through supply (N) 64 by printing device 30B in printing a print job can result in the exhaustion of the one or more of supplies 64. A sensor (l) 66 through sensor (N) 66 can be used to respectively measure and/or sense the quality and/or quantity of supply (l) 64 through supply (N) 64. By way of example, and not by way of limitation, each supply 64 can be a printing supply, a printing media available to be printed on during the printing, a printing substance available for application to the printing media during the printing, toner or ink available for application to the printing media during the printing, a laser printer drum, a laser printer developer, a laser printer fuser, a printing media transfer belt, staples for stapling the printing media during the printing, a storage volume that is available to store paper that has been printed on by the printing device, etc.

Memory tag 36 has a component memory 44, a logic component 46, and an electrical contact or antenna coil 48. The component memory 44 has at least one storage area that can include a replaceable component usage data 50 and an end-of-life status (i) 51. End-of-life status (i) 51 can be used to respectively store an acknowledgement of the end of a serviceable life for supply (l) 64 through supply (N) 64. Memory tag 36, sensor(s) 66, and end-of-life status (i) 51 can individually or collectively operate in conjunction with an interrogating device, also known as an interrogator. An interrogator is a device that provides power to, reads from and/or writes to, the memory tag 36 and/or other aspects of replaceable component 32B. Examples of interrogators include a memory tag reader or scanner, a memory tag writing device which stores data on the memory tag 36, and the like. In the present example, the printing device 30B includes an interrogator 52. Interrogator 52 performs functions of a reader/writer, such as monitoring the contents of component memory 44, readings from one or more sensors 66, and replaceable component usage data 50.

The interrogator 52 can be electrically connected to contact 48 or the interrogator 52 can emits a radio frequency field that provides power to the memory tag 36 and/or other aspects of replaceable component 32B via the antenna coil 48. The memory tag 36 and/or other aspects of replaceable component 32B, therefore, do not require their own power supply. Communications between the interrogator 52 via antenna coil 48 and replaceable component 32B are transmitted and received via the radio frequency field and the antenna coil 48 utilizing standard RFID method and protocol, such as promulgated in ISO 14443 and ISO 15693. Therefore, physical contact for an electrical connection between replaceable component 32B and the printer 30 is not required for the printer 30 to communicate with the memory tag 36 as an RFID memory and/or other aspects of replaceable component 32B.

Each replaceable component 32B communicates with printing device 30B, which includes a printer memory 54. The printer memory 54 contains a print queue 59 and one or more storage areas that can include, but are not limited to, replaceable component usage data (k) 56 and end-of-life status (k) 57. Replaceable component usage data (k) 56 and end-of-life status (k) 57 store data that respectively correspond to replaceable component (l) 32B through replaceable component (i) 32B. Print queue 50 can be used to contain print data for each of one or more print jobs. Each print job is identified by a print job identifier (ID). Alternatively, or in addition thereto, a print queue 71 can also be stored in a memory 73 of a computer 67 that is in communication with printing device 30B. The contents of print queues 59, 71 are discussed more particularly with respect to FIG. 5.

The printing device 30B can have one or more sensors 68 that can be used to respectively monitor one or more supplies 64 of one or more replaceable components 32B. Sensors 68 can also include systems to measure the quantity and/or quality of print media that is available to be used to print on in a printing process. For instance, one of more sensors 68 can be used to weigh the available pieces of paper that can be printed on, which estimate can be used to determine if there is enough paper on which to print a print job. One or more sensors 68 can be used to weigh pieces of paper in an output bin (not shown) so as to estimate the number of pieces of paper that have been printed on by output mechanism 65 and are stored in the output bin. From this estimate and a predetermined maximum capacity page count, a number of pages can be determined for which there is space available in the output bin.

An input mechanism 60 can be associated with printing device 30B that can be a toggle switch or a button that can be depressed or otherwise activated by a user. A printer logic component 62 is included in printing device 30B to execute instructions for a printing operation. Output mechanism 65 can be a printing mechanism to print a print substance on print media (e.g. selectively placing printing ink and/or toner on print media such as paper). Output mechanism 65 can also include a display device for displaying a diagnostic and/or a prompt.

The sensor(s) 66 and/or sensor(s) 68 can be used to measure and/or sense the respective quantity and/or quality of one or more of supply (l) 64 through supply (N) 64 of one or more of respective replaceable component (l) 32B through replaceable component (i) 32B. As such, each sensor 66 and/or sensor 68 can be configured to measure and/or sense the occurrence of an end-of-life condition. By way of example of an end-of-life condition for a replaceable component 32B, a sensor 66/68 can measure the toner in a toner cartridge 32A which measurement indicates an end-of-life condition for the toner in the toner cartridge 32A, a sensed and/or measured lack of a predetermined quality of a particular replaceable component 32B such that an end-of-life condition exists for the particular replaceable component 32B, a predetermined passage of time that a particular replaceable component 32B has been installed in printing device 30B that equates to a corresponding end-of-life condition, a measured and/or counted usage of a particular replaceable component 32B that exceeds a predetermined quantity that signifies a corresponding end-of-life condition for the particular replaceable component 32B, etc.

Printing device 30B is connected to computer 67, which can be any of servers 104A, 110 or workstation 108A seen in FIG. 1. Computer 67 includes memory 73 and a display monitor 70A. Display monitor 70A is an example of monitor 108C seen in FIG. 1. A graphical user interface (GUI) 72A is displayed on the display monitor 70A to provide visual information to the user. One or more counters 73 can be stored in memory tag 36, or in memory 73 of computer 67, to keep count of the historical usage of one or more replaceable components 32B for the purpose of calculating the availability thereof for requested print jobs. A user can use computer 67 to schedule a print job on printing device 30B. A diagnostic with respect to an end-of-life condition of any replaceable component 32B can be displayed upon display monitor 70A. The diagnostic can be a characterization of the end-of-life condition or the results of a measurement and comparison calculation that output the unavailability of any replaceable component 32B to print a requested print job with the number of pages that can be printed using the one or more deficient replaceable components 32B. The display upon display monitor 70A can also include the number of pages in the entire requested print job as calculated by an aspect of one or more printer driver applications. A prompt can be displayed to the user on display monitor 70A that gives instructions as to how to input a demand to print out a number equal to or less than the number of pages in a requested print job that can be printed with available replaceable components 32B as related in the diagnostic.

The computer 67 and printing device 30B are connected via a network 76, such as the Internet, a local area network (LAN), a wide area network (WAN), or the like. Alternatively, computer 67 and printing device 30B can also be connected via a direct connection 78, such as by a parallel, serial, or USB port or other conventional connection scheme.

Figure 5:
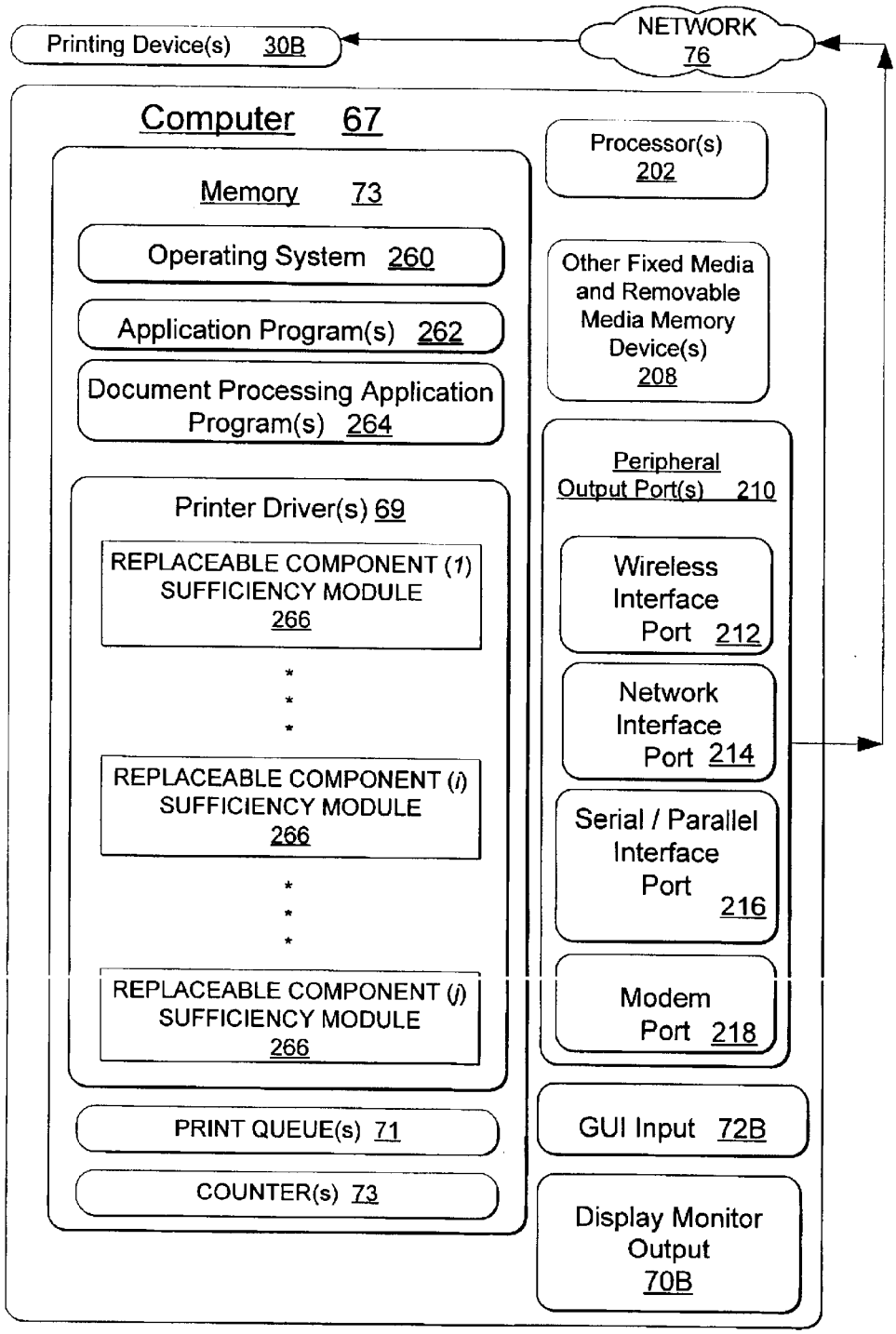
FIG. 5 is a block diagram of a computer in an implementation of a printing system.

FIG. 5 is a block diagram of printing system 40 that shows pertinent components of a computer 67 in accordance with an implementation. Computer 67 seen in FIGS. 4–5, which can be workstation 108A seen in FIG. 1, is a computing device that includes one or more processors 202, memory 73, and one or more print queues 71, one or more counters 73 for counting aspects of one or more of supply (l) 64 through supply (n) 64 of corresponding one or more replaceable components 32B. Other fixed media and removable media memory devices 208 are optionally included in computer 67. Memory devices 73 and 208, which provide data storage mechanisms, can be read-only memory (ROM), random access memory (RAM), a hard drive, a floppy disk drive, a CD-ROM drive, and other conventional memory device, and can be used to store an output buffer that contains a rendered version of a document, a bitmap of an image of one or more pages or segments of a document, or other versions of the document as is appropriate for a particular outputting environment. Other storage uses include a print spool or print buffer.

The one or more processors 202 perform various instructions to control the operation of computer 67. These instructions can be in applications stored in memory devices 73 and/or 208, and include an operating system 260, one or more application programs 262, and one or more document processing applications 264 to process a document such as word processing programs, electronic mail programs, drawing programs, spreadsheet programs, slide show programs, and desk top publishing programs, where some applications can include a spooler component. Also included in the applications executed by the one or more processors 202 are one or more printer drivers 69. The one or more printer drivers 69 include one or more replaceable component sufficiency module 266. Each replaceable component sufficiency module 266 contains instructions that, when executed by the one or more processors 202, calculate whether an available amount of a corresponding replaceable component is sufficient to be used to print out all of an identified print job. The calculation can use measurements and/or counts that are made by one or more counters 73, or by one or more sensors 68, and/or by one or more sensors 66 of one or more corresponding replaceable components 32B. The calculation can also be made using the measurements and/or counts that are stored in replaceable component usage data 50, replaceable component usage data (k) 56, end-of-life status (i), and/or end-of-life status (k). After the foregoing calculations have been made and replaceable component sufficiency is confirmed based upon the counts and/or measurements, each of one or more printer drivers 69, when executed by the one or more processors 202, outputs data to one or more printing devices 30B for further performance of a printing process.

Although FIG. 5 shows memory 73 with one or more application programs 262, one or more document processing applications 264, one or more printer drivers 69, one or more print queues, and one or more counter 73, these applications and storage components could also be stored on a server, such as one or more servers 104A and 110 seen in FIG. 1 and to which computer 67 can have access through interconnected network 76.

One or more peripheral output ports 210 provide a mechanism for computer 67 to communicate with other devices such as to the one or more printing devices 30B. The one or more print drivers 69, when executed, direct data to one or more peripheral output ports 210, which can be a wireless interface port 212, a network interface port 214, a serial port/parallel port 216, and/or a modem port 218. One or more graphical user input device(s) 72B can be used for inputting and outputting data, including a keyboard, a computer mouse, a pointing device, or other mechanism for inputting information to computer 67.

Computer 67 can include one or more rendering engines in the one or more application programs 262 and/or the one or more document processing applications 264 each of which can be executed by the one or more processors 202 so as to be capable of processing print data into a format understood by the respective one or more printing devices 30B so as to be output therefrom. Similarly, the servers 104A, 110 and the workstation 108A seen in FIG. 1 can include respective rendering engines that can process raw data into a language understood by any printer device connected on network 102. These rendering engines can be capable of rendering a document into a directly printable format by incorporating any fonts, templates, or other data required to render the document.

Figure 6:
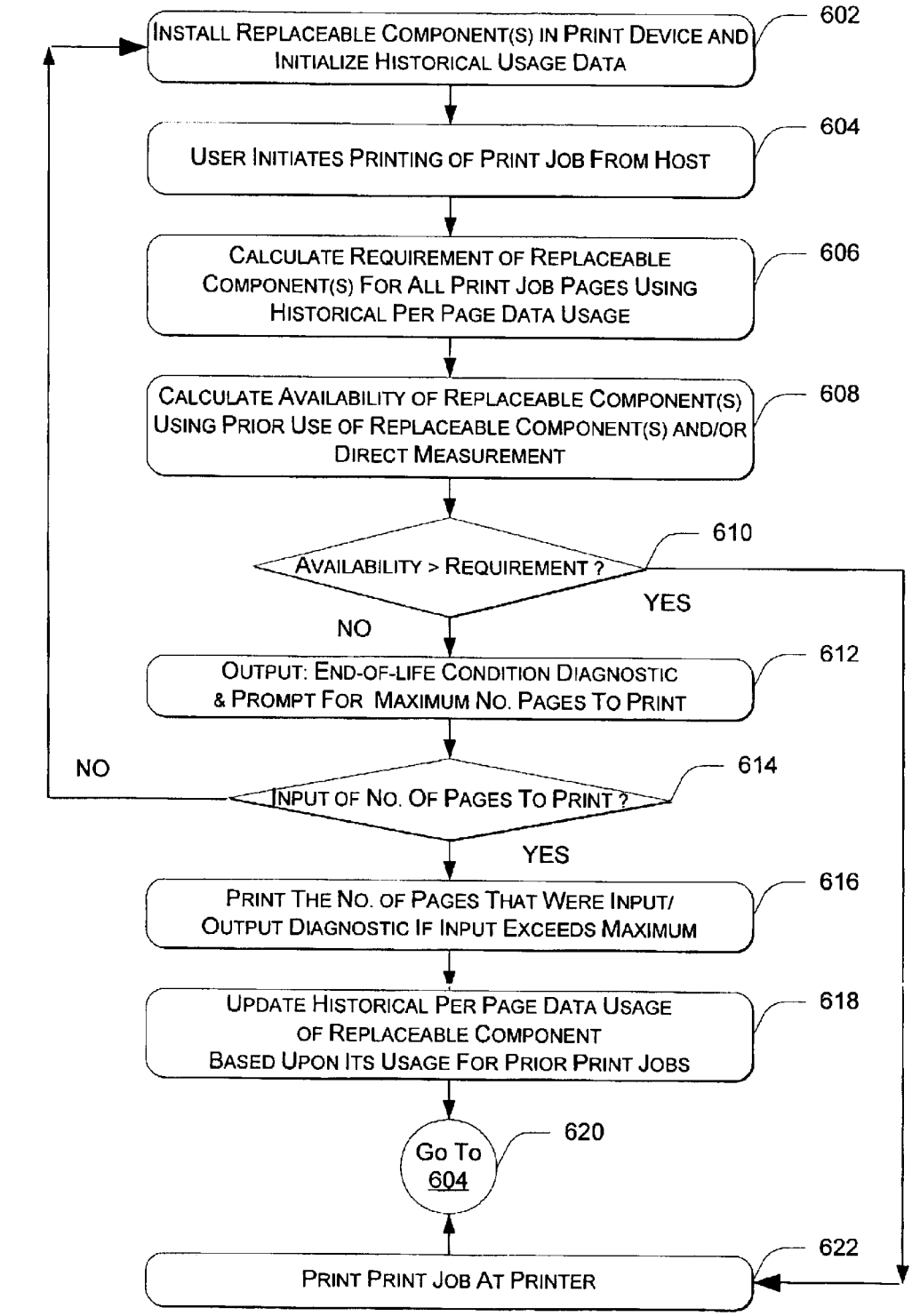
FIG. 6 is a flow diagram of an implementation of a dynamic messaging process utilizing prior use of a replaceable component to estimate availability of same for a print job.

FIG. 6 depicts a process 600 in a flow diagram of a dynamic messaging process for communicating with a user, with particular reference to FIGS. 4–5 for illustrative purposes. At block 602, one or more replaceable components 32B are installed in a printing device 30B and any historical data as to usage of the one or more replaceable components is initialized. A default value for a usage per page of printing for each replaceable component 32B may also be stored. At block 604, a user initiates a request to print a document by scheduling a print job that the user wishes to print at printing device 30B.

At block 606, one or more printer drivers 69 are executed by the one or more processors 202 to calculate the number of pages of the requested print job. One or more replaceable component sufficiency module 266 in the respective one or more printer drivers 69 are executed by the one or more processors 202. Each replaceable component sufficiency module 266 corresponds to one replaceable component 32B and calculates a requirement for the corresponding replaceable component 32B to print all of the pages of the requested print job at the printing device 30B. The calculation of the requirement can use a default value of usage per page or the calculation of the requirement can use a usage per page that is an estimate based upon historical data that has been accumulated from prior print jobs that were printed with the replaceable component 32B at the printing device 30B. The required usage per page of each replaceable component 32B is extrapolated to calculate the required usage of each replaceable component 32B for all of the pages of the entire print job.

At block 608, each replaceable component sufficiency module 266 coordinates an assessment of the availability of each replaceable component 32B at the printing device 30B. The availability is expressed in a number of pages that each replaceable component 32B can print at the printing device 30B. This availability can be assessed by quantifying each replaceable component 32B by measurements and/or determinations of prior usage of the amount or quality of the respective replaceable component 32B. These measurements, counts, and/or estimations can be obtained for use by the respective replaceable component sufficiency module 266 by input received from counters 73, from one or more sensors 68, and/or from one or more sensors 66 of one or more corresponding replaceable components 32B. These measurements, counts, and/or estimations can also be obtained by retrieving data stored in replaceable component usage data 50, replaceable component usage data (k) 56, end-of-life status (i) 51, and/or end-of-life status (k) 57. For instance, if a fuser for a laser printer has a measured quality that indicates that seventy-five percent (75%) of its servable life has been extinguished, which serviceable life is estimated to be twenty-five thousand (25,000) pages, then the availability of the fuser will be estimated to be twenty-five percent (25%) of twenty-five thousand (25,000) pages. Other examples of acquiring the data that is used for assessing availability and requirements for replaceable components with respect to measurements and/or counts and comparisons in which they are used are discussed below in reference to FIG. 8. The results of these measurements, counts, and/or estimations can be stored in memory 73, in other memory devices 208, in memory tag 36, and/or in memory associated with servers 104, 110. For instance, the result of a process that counts each page that is printed using a toner cartridge can be stored for later use.

At block 610, the requirement determined at block 606 and the availability determined at block 608, for each replaceable component 32B for the print job, are subjected to comparison in a query. The query at block 610 determines the sufficiency of each replaceable component 32B to print the requested print job. If the sufficiency of each replaceable component is adequate for the requested print job, then process 600 moves to block 622 where the requested print job is printed from one or more of print queues 59, 71 at printing device 32B, and after which process 600 returns to block 604 for processing as described above. If not, then process 600 moves to block 612 where a diagnostic is output upon display monitor 70A and/or output mechanism 65. The diagnostic informs the requesting user with a characterization as to the nature of the insufficiency of one of more replaceable components 32B that are needed for the requested print job. The diagnostic can also inform the user as to the number of pages, or other printing delimiter, that the printing device 30B will be able to print given the aforesaid one or more insufficiencies. A prompt can also be output with the diagnostic. Example diagnostics and prompts are discussed below in reference to FIG. 7. The prompt informs the user that, given the identified insufficiency of one or more replaceable components, the user may input a lesser number of pages than are in the requested print job. The lesser number of pages can be identified in the prompt. The estimation of some replaceable components or supplies therein may have a built-in margin so that some usable life likely remains when the end of life thereof has been estimated. Thus if a user chooses to print past the end-of-life, there is a good probability that the resulting output may be acceptable.

Where more than one replaceable component 32B has been deemed insufficient for printing all of the pages of a requested print job, each such replaceable component may have a different number of pages that can be printed with their respective availabilities. In order to best use the requesting user's time and for efficiency of the printing process, the first diagnostic that should be output for review by the requesting user should be the least number of pages that can be printed among all of the one of more replaceable components 32B that have been found to be insufficient. In this way, a user need only respond once to the prompt to print at least some of the pages of the requested print job, which response will not exceed the maximum number of pages corresponding to the other deficient replaceable components 32B.

At block 614, if process 600 determines that the prompt was not responded to, process 600 moves to block 602 and waits for replacement of the one or more replaceable components 32B identifies as being insufficient. Otherwise, process 600 moves to block 616 where the number of pages that the user has input in response to the prompt at block 612 is processed. The number of pages should not be greater than the identified maximum number of pages in the prompt, or else one or more replaceable components 32B in the printing device 30B will reach an end-of-life condition before all of the pages of the print job have been printed. In this case, a diagnostic reflecting the same can be output for review and correction by the user. If, however, the number of pages input by the user is not greater than the identified number of pages in the prompt, the requested print job will be printed by the printing device 30B from one or more of print queues 59, 71, but just for the user-specified number of pages.

After the printing at block 616, process 600 moves to block 618 where historical data for each replaceable component that was used in printing the job is updated. For instance, if a measurement is taken that shows that there is fifty percent (50%) of the ink in an ink cartridge that remains after printing eleven hundred (1100) sheets of paper with the ink cartridge at the printing device, the historical data will be updated for the ink cartridge to reflect a per page usage of 0.5 ink cartridges per /1100 pages, or about $4.5\times10^{-4}$ ink cartridges per page. Accordingly, the resultant quality of the printing at printing device 30B will be ensured and process 600 will return to block 604 for further processing as described above. This certainty and quality can be obtained by proper measurement, counting, and/or estimation techniques used to determine the requirements and corresponding availability of one or more replaceable components 32B that are needed to print the requested print job at printing device 30B. Process 600 is repeated for each print job that is requested by the user to have printed at printing device 30B, as has been as described above.

The order in which a method is described with respect to process 600 is not intended to be construed as a limitation, and any number of the described method blocks can be combined in any order to implement the method. Furthermore, the method can be implemented in any suitable hardware, software, firmware, or combination thereof.

When process 600 is operated in an environment where the document processing device is a PC in communication with a printer, several parameters of operation can be implemented within the context of the rendering of the document in the PC and the rendering of the document in the printer. To process an entire print job, the printer may need the ability to interpret a language or format in which the document is stored. For example, if the document data is stored in a raw data format and the printer only understands the Printer Control Language (PCL) language, then the printer cannot process the document until some other device or process converts the raw data into a PCL format. Here, the PC can be this device or perform this process. However, if the document is already stored in a format that is understood by the printer, then the printer can process the document without assistance from an external device. If the printer can process the entire print job, then the document is printed by the printer. If the printer cannot process the entire print job, then the portions of the document (i.e., print job) that it cannot process may be delegated to other processing devices.

Figure 7:
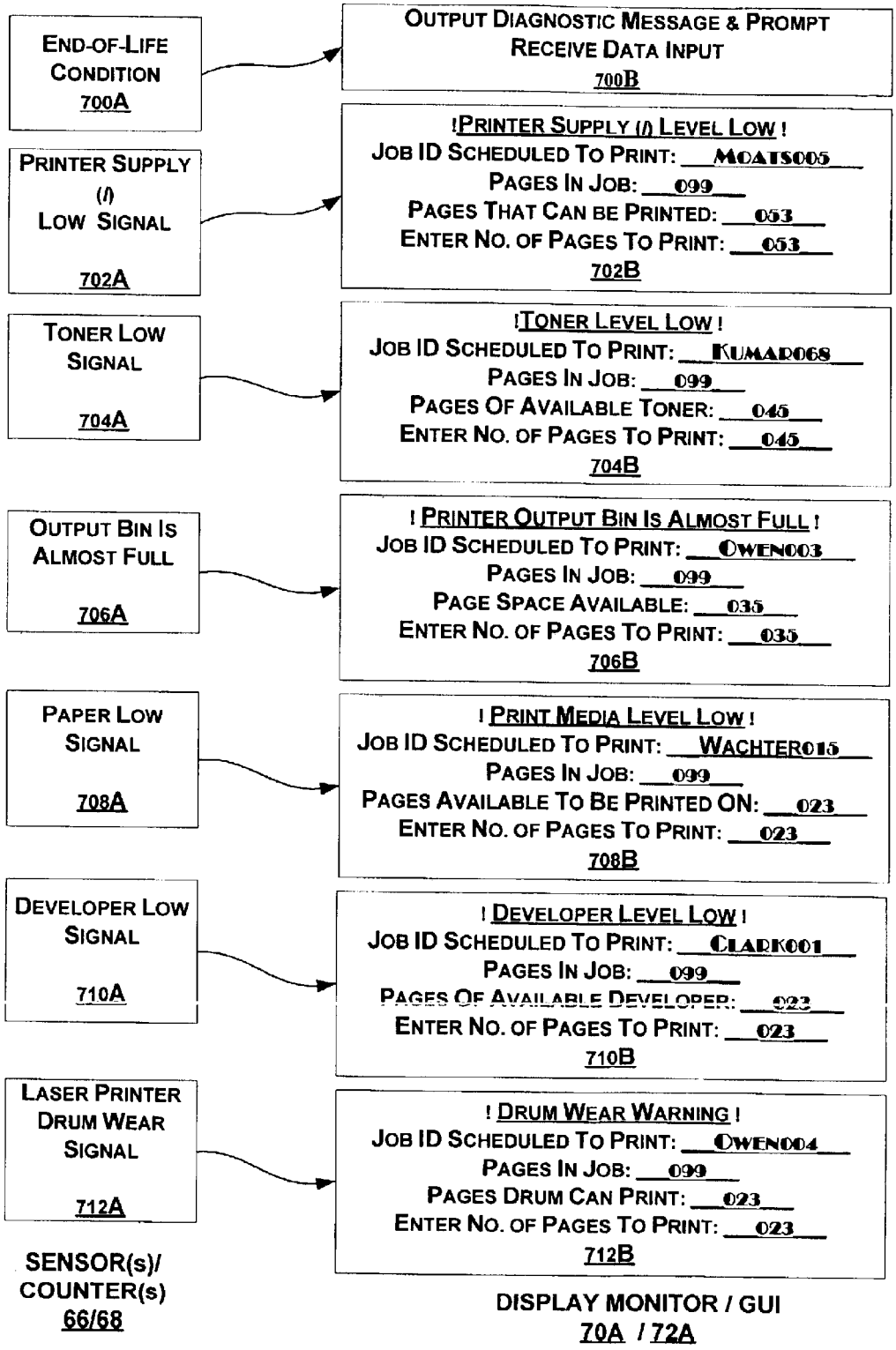
FIG. 7 is a diagram of an implementation of a messaging process for user communication.

By way of example of the output diagnostic referred to in the foregoing process 600, particular reference is made to FIG. 7. As discussed above, the quality and/or quantity of each of one or more replaceable components 32B can be measured, counted, and/or estimated to judge the availability thereof for a completing all or a portion for the number of pages in a requested print job. Measurements can be taken, and monitoring thereof can be performed, by use of one or more sensor(s) 66 or/and sensor(s) 68. Counting of historical usage data can be accumulated in replaceable component usage data 50, replaceable component usage data (k) 56, counter 63, and/or counters 73. Representations of an end of a serviceable life of one or more replaceable components 32B can be stored in end-of-life status (i) 51 and/or end-of-life status (k) 57.

FIG. 7 shows various end-of-life conditions 700A and a corresponding output diagnostic message and prompt for receipt of data input 700B. Where more that one replaceable component is measured, counted, and/or estimated for availability and more than one thereof are found to be lacking in sufficiency for the printing of an identified print job at an identified printing device, then each corresponding diagnostic and prompt can be displayed for review and response by a user. It is more expedient, however, to first output a diagnostic -that corresponds to the least amount of printing for the least available replaceable component so that only one (1) response to a prompt need be made by a user. Alternatively, each of the several diagnostics and prompts seen in FIG. 7 can be output as each insufficiency of a replaceable component is determined for an identified print job at an identified printing device. If the user does not or cannot effect a replacement of the one or more deficient replaceable components to remedy the displays of insufficiency in the respective diagnostics, the user can reply to the prompt as discussed below.

End-of-Life condition 702A is a low supply signal for printer supply (i) 64 to signify that a corresponding supply 64 needed for printing device 30B is too low to print all of the ninety-nine (99) pages of a requested print job that has print job ID MOATS005. The low supply signal can be derived from a measured and/or counted quantification of the level of one or more supplies 64 in a corresponding replaceable component 32B. The diagnostic and prompt 702B corresponding to End-of-Life condition 702A shows the result of an algorithm that calculates the total amount of the supply that is needed for ninety-nine (99) pages of print job ID MOATS005. The results of the algorithm are compared to the quantification of the one or more supplies 64 to arrive at a determination that there is only enough of the one or more supplies 64 to print fifty-three (53) pages of print job ID MOATS005 on printing device 30B. Accordingly, a user responds to the prompt by inputting a request to print the first fifty-three (53) pages of the ninety-nine (99) pages of print job ID MOATS005, as seen in diagnostic and prompt 702B.

End-of-Life condition 704A is a toner low signal that signifies that the level of toner that remains in toner cartridge 32A of laser printer 30A is too low to print all of the ninety-nine (99) pages of a requested print job that has print job ID Kumar068. The low toner signal can be derived from a measurement of the level of toner from as sensed by sensor 66 in toner cartridge 32A. The measured level can be converted into a number of pages given a historical average of the amount of toner that is used per page. The diagnostic and prompt 704B corresponding to End-of-Life condition 704A reflects the estimation that is there is insufficient toner in the toner cartridge 32A to print all of the ninety-nine (99) pages in the entire requested document. As per an output of a diagnostic and prompt 704B, only forty-five (45) pages can be printed at printing device 30B by exhausting the remaining toner in toner cartridge 32A. Accordingly, a user responds to the prompt by inputting a request to print the first forty-five (45) pages of the requested printout, as seen by the response input made by the user in diagnostic and prompt 706B.

End-of-Life condition 706A signals that an output bin for output mechanism 65 of printing device 30B is too full. This determination can be made, for example, by weighing the paper in the output bin, or by use of a level sensor, to determine how much more paper can be placed therein. This amount is then compared to how many pages are in the requested print job. The difference in then reflected in the diagnostic and prompt 706B which shows that of the ninety-nine (99) pages corresponding to print job ID Owen003, thirty-five (35) more pages can be placed in to the output bin before it cannot receive any more pieces of paper. Accordingly, a user responds to the prompt by inputting a request to print the first thirty-five (35) pages of the ninety-nine (99) pages of print job ID Owen003, as seen in diagnostic and prompt 706B.

End-of-Life condition 708A signals that a paper tray for printing device 30B does not have enough sheets of paper in it to complete a print job having the print job ID Wachter015. This determination can be made by weighing the paper in the paper tray, or by use of a level sensor in the paper tray, to determine how much paper is in the tray. This amount is then compared to how many pages are in the requested print job. The difference in then reflected in the diagnostic and prompt 708B which shows that of the ninety-nine (99) pages corresponding to print job ID Wachter015, twenty-three (23) more pages can be printing with the available pieces of paper in the paper tray. Accordingly, a user responds to the prompt by inputting a request to print the first twenty-three (23) pages of the ninety-nine (99) pages of print job ID Wachter015, as seen in diagnostic and prompt 708B.

End-of-life condition 710A characterizes a developer of a laser printer as being of insufficient quality to print all of a print job having a print job ID Clark001. End-of-life condition 710A can be realized by one or more sensors that can be used to gauge the quality of the developer. One or more readings from the one or more sensors are then used to estimate the number of pages that can be printed given the remaining serviceable life of the developer. The number of pages (ninety-nine) is compared to the number of pages (twenty-three) corresponding to print job ID Clark001. Corresponding to end-of-life condition 710A is diagnostic 710B that is output for review by the requesting user or the agent thereof, and that prompts the user to enter a number of pages that they want to have printed. Accordingly, the user responds to the prompt by inputting a request to print the first twenty-three (23) pages of the requested ninety-nine (99) page print job.

End-of-life condition 712A characterizes a drum of a laser printer as being of insufficient quality to print all of a print job having a print job ID Owen004. End-of-life condition 712A can be realized by one or more sensors that can be used to gauge the quality of the drum. One or more readings from the one or more sensors are then used to estimate the number of pages that can be printed given the remaining serviceable life of the drum. The number of pages (ninety-nine) in the entire print job is compared to the number of pages (twenty-three) corresponding to print job ID Owen004. Corresponding to end-of-life condition 712A is diagnostic 712B that is output for review by the requesting user or the agent thereof, and that prompts the user to enter a number of pages that they want to have printed. Accordingly, the user responds to the prompt by inputting a request to print the first twenty-three (23) pages of the requested ninety-nine (99) page print job.

Other End-of-Life conditions are contemplated, such as those that are based upon a measurement, count, and/or estimation of the remaining availability of a replaceable component as determined by use of sensors and/or counters. The sensors and/or counters can be used to count and/or measure qualitative and/or quantitative characteristics of the replaceable components. These replaceable components might also have corresponding memory that is configured to store replaceable component usage data received from a reader/writer located in a printing device. The reader/writer can monitor the replaceable component usage data. The reader/writer can receive input from the sensors and/or counters to predetermine whether, and how many more pages could be printed before, there is an end-of-life condition. The memory can be an RFID memory or a direct contact identification memory. Another aspect of these printer replaceable components can be a page count received from a page counter in the reader/writer that maintains the historical data of a page count which is the number of pages printed using the replaceable component. Once this page count measurement is compared to a predetermined maximum page count, these replaceable components can be deemed to be at an end-of-life condition. Moreover, the page count measurement can be used in combination with data received from one or more sensors used to monitor the quality characteristic of the replaceable components so as to calculate the respective availabilities thereof for future and current printing operations. From these respective availabilities, for example, it might then be determined that only a portion of the total pages in a print job can be printed on a user-designated printing device. A corresponding diagnostic might be output accordingly, as well as a prompt to display a query to a user as to whether all or some of the maximum number of pages in the prompt should be printed at the user-designated printing device. The user can then respond to the prompt by inputting a request to print all or some of the number of pages suggested in the prompt.

End-of-life conditions 700A and corresponding output diagnostic messages and prompts for receipt of data input 700B can be stored in a message lookup table (not shown) contained in any of memory 73, memory tag 36, and/or in printer memory 54. Those of ordinary skill in the relevant arts, using the present patent as a guide, will understand that the calculations for an end-of-life condition of a replaceable component for a printing device can be made by use of known techniques and known quality and quantity measurement capabilities. Accordingly, the scope of the implementations is intended to include those techniques and measuring capabilities now known and yet to be developed.

FIG. 8 presents a table of replaceable components in the first column, a second column containing a list of sensors and counters for historical data that can be used to determine the quality and/or the quantity of the replaceable component in the same row, and a third column that shows an algorithm for measuring, counting, and/or estimating the sufficiency of the replaceable component in the same row for printing an entire requested print job. The text of the table entries respectively identifies the replaceable components, the historical data and sensor measurements, and the end-of-life calculations. Different ways exist for one or more of the historical data, counter(s), and/or sensor(s) to be used retrieve and coordinate the display diagnostics and prompts related to the end-of-life calculations for respective replaceable components, such as by the execution of instructions on one or more logic components 46, on one or more printer logic components 62, and/or on computer 66. Those of ordinary skill in the relevant arts can use this patent as a guide in implementation of any such way.

In one implementation, a replaceable component can be weighed to determine whether or not the amount thereof at a printing device will be sufficient to print the units (e.g. pages) of a print job. By way of example, if historical data has been collected at a printing device that shows that 600 grams of toner will print 100 pages, then the usage of the toner is estimated to be 6 grams per page. If a user requires a print job to be printed at the printing device that has 1000 pages, then the toner requirement for the print job is 6000 grams of toner. A sensor associated with a toner cartridge at the printing device is configured to weigh the available of toner. The sensor senses that there are 66 grams of toner available to print the print job. As such, execution of a printer driver for the printing device would estimate an insufficiency of 5934 grams of toner, thus allowing only 11 pages of the 1000 page print job to be printed at the printing device with the available toner in the toner cartridge. Accordingly, a user can input a demand for eleven (11) of the 1000 pages to be printed to the exclusion of the other 989 pages in the print job.

In another implementation, a replaceable component can have its availability estimated based upon its predetermined serviceable life. By way of example, if the replaceable component has a predetermined availability of 5000 pages for a printing device and a counter has already logged 4500 pages of printing with the replaceable component at the printing device, the replaceable component has an estimated availability of 500 pages of printing at the printing device. When a printer driver is executed following a user demand to schedule a 1000 page print job for printing at the print device, a diagnostic will be output that characterizes an insufficiency of 500 pages of the print job due to the availability of the replaceable component at the printing device.

The printed document that is printed by a printing device in various implementations can have many forms. For instance, the document can be a letter containing text that is being edited by a word processing program, an electronic mail (e-mail) message that is being created by an e-mail program, a drawing that is created by the user by operating a drawing program, a spreadsheet that the user is constructing by operating a spreadsheet program, or a poster that is being designed by a user by operating a desktop publishing program. Other types of documents are also contemplated for use in the implementations.

In various implementations, the printing device can be a simple dot matrix printer or a complex printer such as a digital press or a network printer. Complex printers can have capabilities that include high quality photo reproduction, multi-section reports with tabs, in-line mixed material insertion such as insertion of full-color preprinted copies and digital color-page insertion. Other complex printer capabilities include printing on substrates of varied composition, such as embossed, heavy-weight, multi-weight, and cover paper stock, as well as carbonless paper, blue prints, clear or colored transparency printing, and other specialty stock including preprinted offset color covers. Still other complex printer capabilities includes binding, collating, folding, stacking, stapling, stitching such as saddle stitching, edge-trimming, paginating for multi-language, and inline pagination and annotation. Still another printer is a multifunction peripheral (MFP), sometimes referred to as an "All-In-One", which combines two or more peripheral devices into a single device, such as printing, scanning, copying, and facsimile transmission. The printer can be a Graphical Display Interface (GDI) printer or a printer interpreting a page description language.

In other implementations, the document processing application executes on a logic component of the document processing device to form a bitmap image of a document that is communicated to the printing device through the interconnected network. In still another implementation, the document processing application is including in a word processing application. In yet another implementation, the document processing application includes a spooler for spooling print jobs that are to be communicated to the printing device through the interconnected network or through a hardware port on a PC.

Thus, although some implementations of the various methods, printing devices, and toner cartridges have been illustrated in the accompanying Drawings and described in the foregoing Detailed Description, it will be understood that the invention is not limited to the exemplary implementations disclosed, but is capable of numerous rearrangements, modifications and substitutions without departing from the scope of the invention as set forth and defined by the following claims.

What is claimed is:

1. A method comprising:

calculating a requirement of a replaceable component to print a print job at a printing device;

outputting a diagnostic if an availability of the replaceable component at the printing device is less than the requirement, wherein:

the requirement and the availability are approximations expressed in a number of pages; and the requirement is derived from a predetermined use per page of the replaceable component at the printing device; and receiving an input number of pages in response to the diagnostic; and printing UP to the input number of pages of the print job at the printing device.

2. The method as defined in claim 1, wherein the outputting a diagnostic further comprises outputting an identifier (ID) of the print job and an identification of the replaceable component.

3. The method as defined in claim 1, wherein:

the input number of pages is not greater than the availability; and the printing of the input number of pages uses an amount of the replacement component corresponding to the input number of pages.

4. The method as defined in claim 1, wherein the printing up to the input number of pages further comprises transmitting the input number of pages to the printing device for the printing of a portion of the print job.

5. The method as defined in claim 1, wherein the diagnostic includes the difference, expressed in pages, between the availability and the requirement.

6. The method as defined in claim 1, wherein the predetermined use per page of the replaceable component at the printing device is a default value.

7. The method as defined in claim 1, wherein the replaceable component is selected from the group consisting of:

printing media available to be printed on during the printing;

printing substance for printing on the printing media;

toner available for application to the printing media;

an ink cartridge for an ink jet printer;

a laser printer drum;

a laser printer developer;

a laser printer fuser;

a printing media transfer belt;

staples for stapling the printing media; and an output volume available for storage of the printing media that is to be printed on.

8. The method as defined in claim 1, wherein the availability of the replaceable component at the printing device to print the print job is measured by feeding each sheet of a plurality of said sheets in an input bin with a sheet feeder while counting each said sheet to measure the number of pieces of paper in the input bin.

9. The method as defined in claim 1, wherein the availability of the replaceable component at the printing device to print the print job is measured by:

feeding each sheet of a plurality of said sheets in an output bin with a sheet feeder while counting each said sheet; and subtracting the number of the counted sheets of paper from a maximum number of pieces of paper for storage in the output bin to determine the number of pieces of paper that can still be stored in the output bin.

10. The method as defined in claim 1, wherein the availability of the replaceable component at the printing device to print the print job is measured by:

weighing an amount of printing substance available for printing on a printing media; and deriving the availability of the replaceable component at the printing device as a function of the weight of the amount of printing substance available for printing on a printing media.

11. The method as defined in claim 1, wherein the availability of the replaceable component at the printing device to print the print job is measured by:

sensing one or more qualitative characteristic of the replaceable component; and calculating a number of pages that can be printed at the printing device as a function of the sensed one or more qualitative characteristics, wherein the calculated number of pages is the availability of the replaceable component at the printing device.

12. The method as defined in claim 11, wherein the replaceable component is selected from the group consisting of:

an ink cartridge for an ink jet printer;

a laser printer drum;

a laser printer developer;

a laser printer fuser; and a printing media transfer belt.

13. The method as defined in claim 1, wherein the calculating is performed by execution of one or more printer driver applications.

14. The method as defined in claim 1, wherein the calculating is in response to a demand to print the print job at the printing device.

15. The method as defined in claim 1, wherein the calculating further comprises using a default value as the predetermined use per page until the printing device has printed a predetermined number of threshold of pages using the replaceable component, and then setting the predetermined use per page to a historical use per page derived from the amount of replaceable component used by the printing device to print the predetermined threshold number of pages.

16. The method as defined in claim 1, wherein the calculating further comprises approximating the requirement without prerasterizing the print job.

17. The method as defined in claim 16, wherein the predetermined use per page is a 'per-page' derivation based upon historical use of the replaceable component per page of printing at the printing device.

18. rewritten as follows:

A computer-readable medium having computer-executable instructions which, when executed on a processor, direct a computer having a capability to communicate with a printing device to perform a method comprising:

determining a number of pages of a print job to print at a printing device;

determining the amount of one or more replaceable components at the printing device;

calculating a usage per each said page for each said replaceable component at the printing device using an amount of each said replaceable component that has been used to print a number of pages at the printing device using each said replaceable component;

calculating an availability number of the pages that can be printed at the printing device with each said replaceable component at the printing device using the respective usage per each said page and the respective measured amount of each said replaceable component;

calculating a requirement number of the pages that can be printed at the printing with each said replaceable component at the printing device using the respective usage per each said page and the number of the pages in the print job;

transmitting the designated print job for printing at the printing device when each said availability number of the page is not less than the number of the pages in the print job;

outputting a diagnostic without transmitting the designated print job for printing at the printing device when at least one said availability number of the pages is less than the number of the pages in the print job;

after outputting the diagnostic, receiving input of a quantity of the pages not greater than a quantity corresponding to the at least one said availability number of the pages; and transmitting the print job to the printing device.

19. The computer-readable medium as defined in claim 18, wherein the calculating a requirement number further comprises approximating the requirement number without prerasterizing the print job.

20. The computer-readable medium as defined in claim 18, wherein the outputting a diagnostic further comprises outputting an identifier (ID) of the print job and an identification of at least one said replaceable component corresponding to the at least one said availability number of the pages.

21. The computer-readable medium as defined in claim 18, wherein the outputting a diagnostic further comprises outputting, for at least one said replaceable component, a characterization of the difference between the availability number of the pages and the requirement number of the pages.

22. The computer-readable medium as defined in claim 18, wherein the method further comprises transmitting the received input quantity of the pages to the printing device for the printing of a portion of the print job.

23. The computer-readable medium as defined in claim 18, wherein each said replaceable component is selected from the group consisting of:

printing media available to be printed on during the printing;

printing substance for printing on the printing media;

an ink cartridge for an ink jet printer;

toner available for application to the printing media;

a print cartridge for a laser printer;

a laser printer drum;

a laser printer developer;

a laser printer fuser;

a printing media transfer belt;

staples for stapling the printing media; and an output volume available for storage of the printing media that is to be printed on.

24. rewritten as follows:

A computer-readable medium having computer-executable instruction which, when executed on a processor, direct a computer having a capability to communicate with a printing device to perform a method comprising:

determining a number of pages of a print job to print at a printing device;

determining the amount of one or more replaceable components at the printing device;

calculating a usage per each said page for each said replaceable component at the printing device using an amount of each said replaceable component that has been used to print a number of pages at the printing device using each said replaceable component;

calculating an availability number of the pages that can be printed at the printing device with each said replaceable component at the printing device using the respective usage per each said page and the respective measured amount of each said replaceable component;

calculating a requirement number of the pages that can be printed at the printing with each said replaceable component at the printing device using the respective usage per each said page and the number of pages in the print job;

transmitting the designated print job for printing at the printing device when each said availability number of the page is not less than the number of the pages in the print job;

outputting a diagnostic without transmitting the designated print job for printing at the printing device when at least one said availability number of the pages is less than the number of the pages in the print job, wherein the diagnostic is descriptive of one or more of said replaceable components for which the availability number of the pages is less than the number of the pages in the print job;

wherein the method further comprises, after the outputting a diagnostic:

receiving input that identifies a number of pages equal to or less than the availability number of the pages for one said replaceable component for which the availability number of the pages is less than the number of the pages in the print job; and directing the printing device to print only the identified number of pages.

25. A host computing system comprising:

means for calculating a requirement amount of a replaceable component that is needed in order to print a print job at a printing device without prerasterizing the print job;

means for outputting, prior to printing the print job at the printing device, a diagnostic if the available amount of the replaceable component at the printing device to print the print job is less than the requirement amount; and means for:

receiving input of a quantity not greater than the available amount of the replaceable component at the printing device; and transmitting the designated print job for printing at the printing device.

26. The host computing system as defined in claim 25, wherein:

the means for calculating uses a predetermined value to calculate the requirement amount; and the predetermined value is an average use per page that is based upon prior use of the replaceable component to print pages at the printing device.

27. The host computing system as defined in claim 25, wherein prior to use of the replaceable component at the printing device, the predetermined value is a default value.

28. The host computing system as defined in claim 25, wherein each said means is provided by a printer driver application executed by the host computing system.

29. The host computing system as defined in claim 25, wherein the means for outputting a diagnostic further comprises means for outputting an identifier (ID) of the print job and an identification of the replaceable component.

30. The host computing system as defined in claim 25, wherein the means for outputting a diagnostic further comprises means for outputting a characterization of the difference between the available amount and the requirement amount.

31. The host computing system as defined in claim 25, further comprising means for transmitting the received input quantity to the printing device for the printing of a portion of the print job that uses an amount of the replacement component corresponding to the received input quantity.

32. The host computing system as defined in claim 25, wherein the replaceable component is selected from the group consisting of:

printing media available to be printed on during the printing;

printing substance for printing on the printing media;

an ink cartridge for an ink jet printer;

toner available for application to the printing media;

a laser printer cartridge;

a laser printer drum;

a laser printer developer;

a laser printer fuser;

a printing media transfer belt;

staples for stapling the printing media; and an output volume available for storage of the printing media that is to be printed on.

33. rewritten as follows:

A host computing system comprising:

means for calculating a requirement amount of a replaceable component that is needed in order to print a print job at a printing device without prerasterizing the print job, wherein the requirement amount is expressed in number of pages;

means for outputting, prior to printing the print job at the printing device, a diagnostic if the available amount of the replaceable component at the printing device to print the print job is less than the requirement amount, said outputting means further comprising means for outputting the number of pages of the requirement amount;

further comprising means for, after outputting a diagnostic:

receiving input of a number of pages not greater than the number of pages of the requirement amount; and transmitting the designated print job and the received input number of pages to the printing device for the printing of the received input number of pages of the print job.

* * * * *

UNITED STATES PATENT AND TRADEMARK OFFICE

CERTIFICATE OF CORRECTION

PATENT NO. : 6,761,427 B1
DATED : July 13, 2004
INVENTOR(S) : Kevin Owen et al.

It is certified that error appears in the above-identified patent and that said Letters Patent is hereby corrected as shown below:

Column 13,
Line 20, delete "-that" and insert therefor -- that --

Column 17,
Line 36, delete "UP" insert therefor -- up --

Column 20,
Line 15, delete "rewritten as follows:"

Column 22,
Line 17, delete "rewritten as follows:"

Signed and Sealed this

Eighth Day of February, 2005

JON W. DUDAS
*Director of the United States Patent and Trademark Office*